US007874183B2

(12) United States Patent
Fehrenbacher

(10) Patent No.: US 7,874,183 B2
(45) Date of Patent: Jan. 25, 2011

(54) KNITTING MACHINE NEEDLE WITH MEANDERING SLIT CURVE

(75) Inventor: Eckhard Fehrenbacher, Tübingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/571,813

(22) Filed: Oct. 1, 2009

(65) Prior Publication Data

US 2010/0083707 A1 Apr. 8, 2010

(30) Foreign Application Priority Data

Oct. 2, 2008 (EP) ..... 08165777

(51) Int. Cl.
*D04B 35/02* (2006.01)

(52) U.S. Cl. ..... 66/123

(58) Field of Classification Search ..... 66/116, 66/121, 122, 120, 123, 124
See application file for complete search history.

(56) References Cited

U.S. PATENT DOCUMENTS 1,441,591 A * 1/1923 La Montagne ..... 66/115
4,625,527 A * 12/1986 Fukuhara ..... 66/123
4,681,150 A * 7/1987 Fukuhara ..... 163/5
5,094,091 A * 3/1992 Treuz et al. ..... 66/123
5,901,582 A * 5/1999 Hennig et al. ..... 66/123
6,122,938 A 9/2000 Henning
6,860,121 B2 * 3/2005 Jurgens et al. ..... 66/123
6,892,556 B2 * 5/2005 Landenberger ..... 66/123
2004/0172983 A1 9/2004 Jurgens
2005/0016222 A1 1/2005 Landenberger

FOREIGN PATENT DOCUMENTS

DE 3612316 10/1986
DE 8913293 12/1989
DE 19740985 4/1999
DE 10333172 4/2005
EP 1437434 7/2004

* cited by examiner

*Primary Examiner*—Danny Worrell
(74) *Attorney, Agent, or Firm*—Fitch, Even, Tabin & Flannery; Norman N. Kunitz

(57) ABSTRACT

A knitting machine needle (1) that is designed as a meander needle in accordance with the invention comprises at least one meander curve (12) that is provided with a meander curve slit (18) having the shape of a vertical slit that is parallel to the tongue slit. It is delimited by two side walls (19, 20) that are preferably aligned parallel to each other and circumscribe an open intermediate space.

14 Claims, 5 Drawing Sheets

KNITTING MACHINE NEEDLE WITH MEANDERING SLIT CURVE

CROSS-REFERENCE TO RELATED APPLICATION

This application claims the benefit of foreign priority under 35 U.S.C. §119 based on European patent application No. 08 165 777.7, filed Oct. 2, 2008, the entire disclosure of which application is hereby incorporated by reference.

BACKGROUND OF THE INVENTION

The invention relates to a knitting machine needle.

The demands made on knitting machine needles in view of resistance to wear as well as in view of operating speed are becoming increasingly greater. With increasing operating speed, the individual needles are more strongly accelerated and decelerated in their longitudinal direction. This increases the risk of defects on the knitting machine needles, in particular, the risk of hook breakage. Indeed, the operating speed of knitting machines is to be increased, but this must not occur to the detriment of the useful life of the individual knitting machine needles.

In order to attenuate or eliminate the aforementioned problems, German patent document DE 103 33 172 A1 has suggested that a latch-type needle have a slit extending transversely through the needle's meander curve. This slit divides the meander curve into an upper and a lower branch and provides the needle with additional elasticity. Even though this solution has been proven, other options for increasing the useful life of knitting machines at increased operating speed are being sought.

Referring to a meander needle, German patent DE 197 40 985 C2 has suggested that such a needle be provided, in part, with lateral flat recesses in order to provide room in the flanks for lubricants and in order to reduce the friction of the needles along the needle channel wall.

German patent Document 36 12 316 suggests that flat, continuous longitudinal grooves be provided in the lateral surfaces of a meander needle so as to impart the needle with an I-shaped profile in cross-section.

It has been found that the relationships between the geometric features on a knitting machine needle and their effect on long-term fatigue resistance, hook breakage and potential operating speeds are highly complex and hardly predictable. In addition, there are the aspects of manufacturing safety and manufacturing simplicity.

It is the object of the invention to provide a knitting machine needle that satisfies the aforementioned demands.

SUMMARY OF THE INVENTION

The above object generally is achieved according to the present invention with a knitting machine needle having a needle body that is provided with at least one meander curve between the hook and the foot. A slit is provided in the meander curve, with the slit extending at least through the upper and the lower narrow side of the shank of the body.

The meander curve slit extends parallel to the two flat sides or flanks of the knitting machine needle into the shank or through said shank. The meander curve slit may be empty or, if needed, may also be filled with material that is different from the material or the remainder of the needle body. If the needle body consists of steel, the meander curve slit may be filled with a different metal or with a plastic material. It may also remain empty and fill with oil or abraded textile material, for example, during operation. This effect may be deliberately used in order to achieve an damping effect in the slit zone of the meander curve. It is preferred that, in the delivered condition of the knitting machine needle, the meander curve slit display clear patency.

The knitting machine needle in accordance with the invention displays an increased useful life. The meander curve slit has the effect of reduced needle breakage, even at and in particular at high operating speed. On the other hand, the needle shank displays a stability that is high enough that the positioning of the hook during the knitting operation is also precise at high operating speeds.

The meander curve comprises at least one section that extends transversely to the longitudinal direction and two sections adjoining said latter section, said two sections extending in longitudinal direction of the needle. The meander curve slit intersects at least one of these sections. Preferably, said meander curve slit intersects two of these sections or all three of them, whereby it may be continuous from one narrow side to the other narrow side of the knitting machine needle. It may also prove to be practical to configure the meander curve slit in such a manner that it fully divides only one or two of said sections, or only cuts, but does not completely divide, only one or two of said sections.

The meander curve slit has a hook-side end and a foot-side end. Both ends are represented by narrow surfaces that may be straight or rounded. In so doing, it is preferred that the affected surface be arranged inclined with respect to the longitudinal axis of the knitting machine needle. In so doing, the stability properties and the damping properties of the needle may be affected, and intrinsic resonances may be suppressed or absorbed. In addition, a simple manufacturing option is the result.

It has been found to be advantageous to provide the meander curve slit in one plane with or in alignment with the latch slit. In so doing, it may be of advantage for the meander curve slit to have the same width as the latch slit. The meander curve slit may display a consistent single, uniform width. However, it is also possible to provide slits having different widths. This feature may also be used to—at the same time—adapt the knitting machine needle to high operating speeds while maintaining high stability.

Other embodiment options are within the framework of the invention. A few of them are illustrated in the drawings and in the description. In so doing, the description is restricted to essential aspects of the invention and miscellaneous situations. The drawings disclose additional details and may be used for supplementary reference.

DETAILED DESCRIPTION OF THE INVENTION

Figure 1:
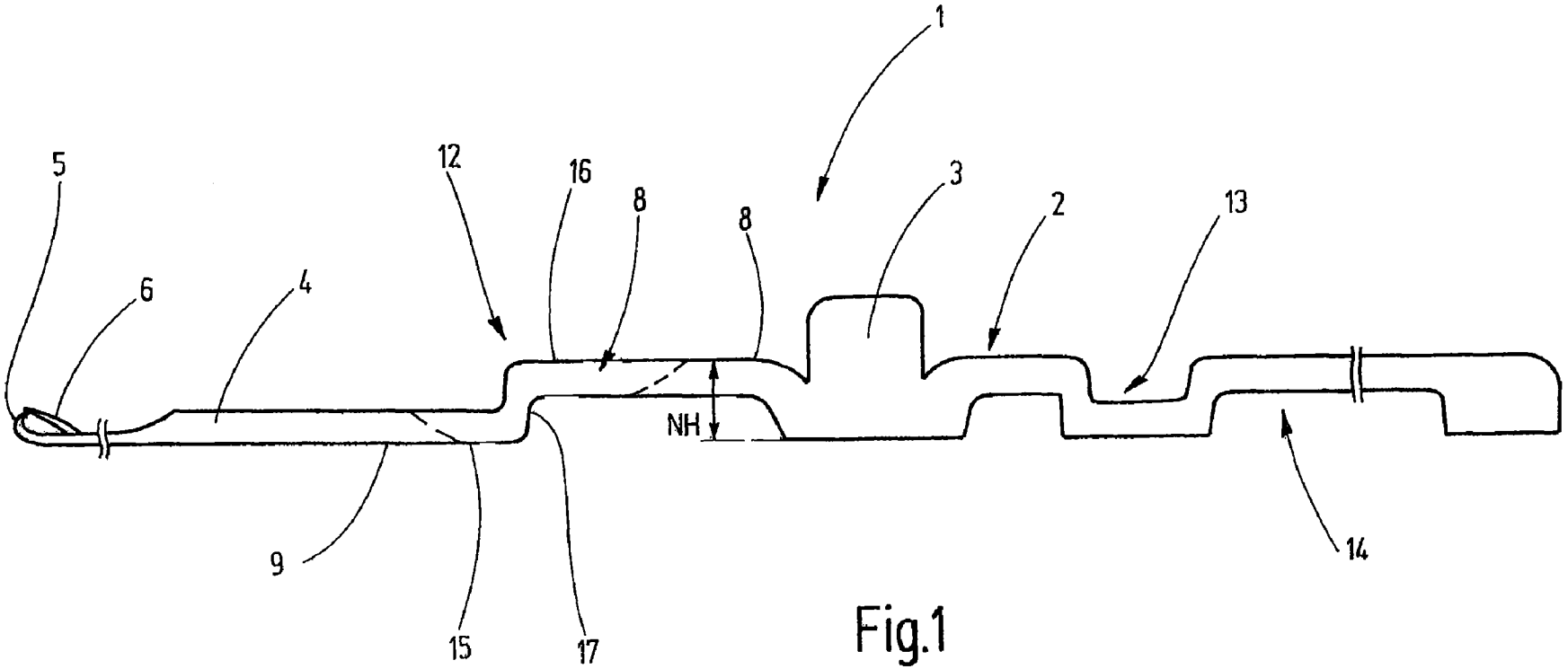
FIG. 1 is a schematic side view, not to scale, of a knitting machine needle.

FIG. 1 shows a knitting machine needle 1 that is configured as a latch-type needle. It has a needle body 2 that has a foot 3.

Figure 2:
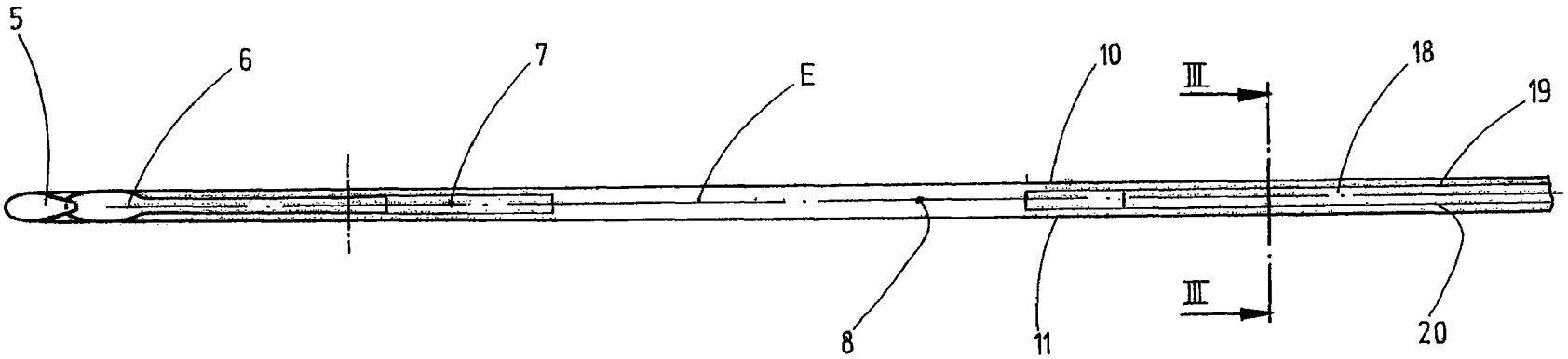
FIG. 2 is a detail of a plan view of the knitting machine needles in accordance with FIG. 1.

It is disposed to drive the knitting machine needle 1 that is supported in a channel of the needle bed such as, for example, a knitting cylinder or a knitting machine dial. The needle body 2 represents a longitudinally extending shank 4 having a hook 5 on its end. The hook 5 is associated with a latch 6 that is pivotally supported in order to be able to open and close the hook 5. A latch slit 7 is disposed to accommodate the latch 6, as is obvious from FIG. 2. FIG. 2 shows a plan view of the upper narrow side 8 of the latch-type needle 1. In addition, the shank 4 has a lower narrow side 9 and is additionally delimited by two lateral surfaces 11, 10 that, preferably, have a flat shape and are arranged parallel to each other.

The needle body 2 and/or the shank 4 are provided with at least one, preferably however several, meander curves 12, 13, 14. In particular, however, at least one meander curve 12 is provided between the foot 3 and the hook 5.

Each meander curve consists of at least two straight bar-shaped sections 15, 16 that extend in longitudinal direction of the needle and an interposed third section 17 that extends in a direction transverse thereto, namely approximately parallel to the foot 3. Consequently, each meander curve 12, 13, 13 forms a step extending in vertical direction, at which step the sections 15, 16 are offset relative to each other. In so doing, each of the sections 15, 16 preferably has a rectangular cross-section (optionally with rounded corners) and the height H. Preferably, their measured height—vertical in FIG. 1, i.e., parallel to the foot 3—is smaller than half the total height NH that is measured from the highest elevation of the upper narrow side 8 to the lowest position of the lower narrow side 9.

Figure 3:
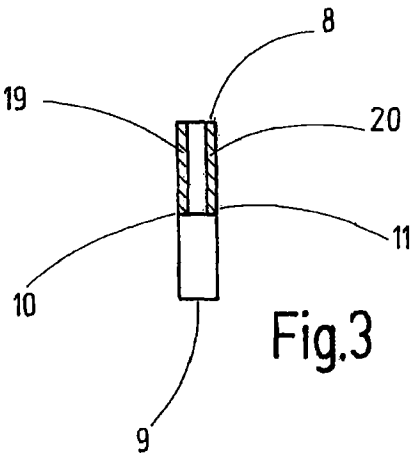
FIG. 3 is a sectional view, along line III-III, of the knitting machine needle in accordance with FIG. 2.

A special feature of the knitting machine needle 1 in accordance with the invention is a meander curve slit 18 that extends in longitudinal direction of the needle and is arranged on the meander curve 12 as well as, optionally, also on the other meander curves 13, 14. In accordance with FIG. 2, the meander curve slit 18 is located in the same plane E with the latch slit 7 and extends through at least one of the narrow sides 8, 9. However, it is closed toward the two lateral surfaces 10, 11. Consequently, said slit is delimited by parallel, thin lateral walls 19, 20, between which the empty space forming the meander curve slit 18 is formed. As is particularly obvious from FIGS. 2 and 3, the walls 19, 20 have a preferably uniform and matching thickness that changes again—viewed in longitudinal direction of the needle—in the vertical direction being perpendicular thereto, and, in one exemplary embodiment, corresponds to the width of the meander curve slit 18.

Preferably, the meander curve slit 18 has the same width as the latch slit 7, whereby the width is the distance between the respective lateral walls 19, 20 of the meander curve slit 18, respectively, or the lateral walls of the latch slit 7 and is measured in a direction transverse to the longitudinal direction of the needle.

Figure 4:
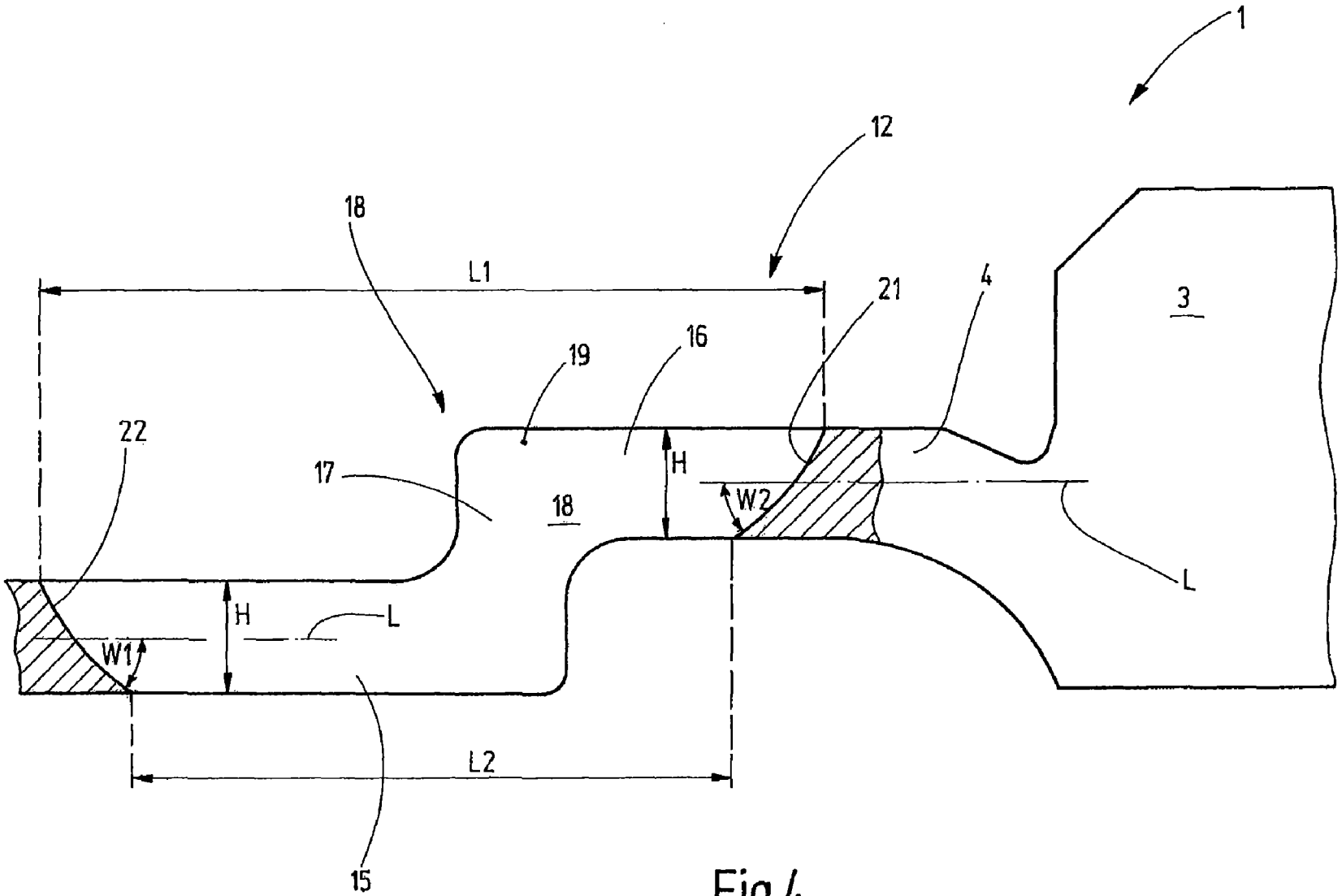
FIG. 4 is a detail of a side view, partially in vertical section, of the knitting machine needle in accordance with FIG. 1.

As is clearly obvious from FIG. 4, the meander curve slit 18 may extend through all three sections 15, 16, 17. On the side facing the foot, as well as on the side facing the hook, the meander curve slit 18 terminates at an end surface 21, 22 that may be flat or, as illustrated by FIG. 4, may also be rounded. The flat or rounded end surfaces 21, 22 are preferably oriented at a diagonal relative to the longitudinal direction of the shank 4. Together with the longitudinal direction L of the needle, they—as is symbolically indicated in FIG. 4—subtend an acute angle w1, w2.

The length of the meander curve slit is clearly greater than its width. Due to the inclination and/or curvature of the end surfaces, the length L1 of the meander curve slit 18 on the upper narrow side 8 is different from the length L2 of the meander curve slit 18 on the lower narrow side 11. In the given exemplary embodiment, L1 is greater than L2. In addition, in the present exemplary embodiment, the meander curve slit 18 is continuously open, i.e., the meander curve slit 18 is empty between the end surfaces 21 and 22 and without connection between the lateral walls 19, 20. However, such connections may be provided if needed, for example, in the form of fillings or also in the form of a one-piece seamless material connection between the lateral walls 19, 20, for example, at one or several points of the sections 15-17.

Preferably, the lateral walls 19, 20 have a flat shape on the outer lateral surfaces 10, 11, as well as on their interior sides. However, they may also be bent toward each other, so that the meander curve slit 18 is constricted at one or more locations. The lateral walls 19, 20 may be next to each other or, for example, may also be connected to each other by spot-welding.

The knitting machine needle 1 described so far operates as follows:

During operation, the knitting machine needle 1 is located in a needle channel of a needle bed. The foot 3 is in connection with a tappet that moves the needle back and forth in longitudinal direction L, i.e., drives the needle out or retracts the needle. In so doing, the hook 5 performs a rapid back-and-forth movement in order to pick up threads and pull them through existing loops. In so doing, the latch 6 continuously oscillates back and forth. The shocks occurring during the movements of the needle that are transmitted to the foot 3 travel through the shank 4 in the direction of and to the hook 5. The meander curve slit 18 ensures, on the one hand, that the driving movement of the foot 3 is transmitted properly and precisely to the hook 5. In so doing, the hook is positioned in a precise manner. The meander curve slit ensures, on the other hand, that shocks that could result in damage to the hook 5, are kept away from said hook or are absorbed.

Figure 5:
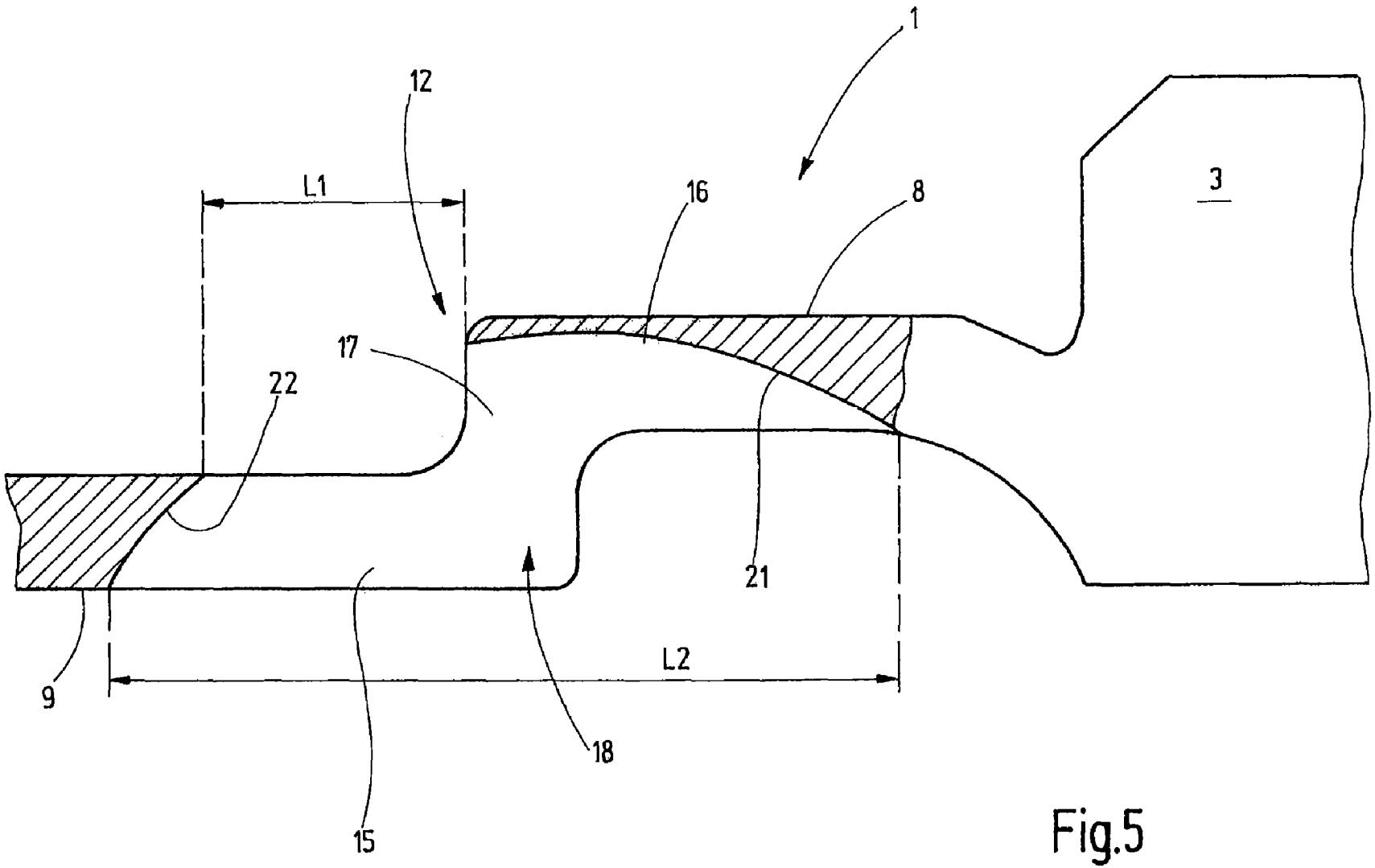
FIGS. 5 and 6 are side views, partially in vertical section, of modified embodiments of the knitting machine needle in accordance with the invention.

FIG. 5 shows a modified embodiment of the knitting machine needle 1 in accordance with the invention. With the exception of the shape of the meander curve slit 18 it corresponds to the above-described knitting machine needle 1.

Referring to the embodiment in accordance with FIG. 5, the meander curve slit 18 extends fully through the sections 15 and 17 of the meander curve 12 and only partly through section 16. In addition, the length L2, in this case, is clearly greater than the length L1. The meander curve slit 18 has a greater length on the lower narrow side 9 than on the upper narrow side 8. However, it is again oriented parallel to the latch slit 7. In addition, it has a uniform width that, preferably, corresponds to the width of the latch slit. However, the width may also be fixed to be different.

Figure 6:
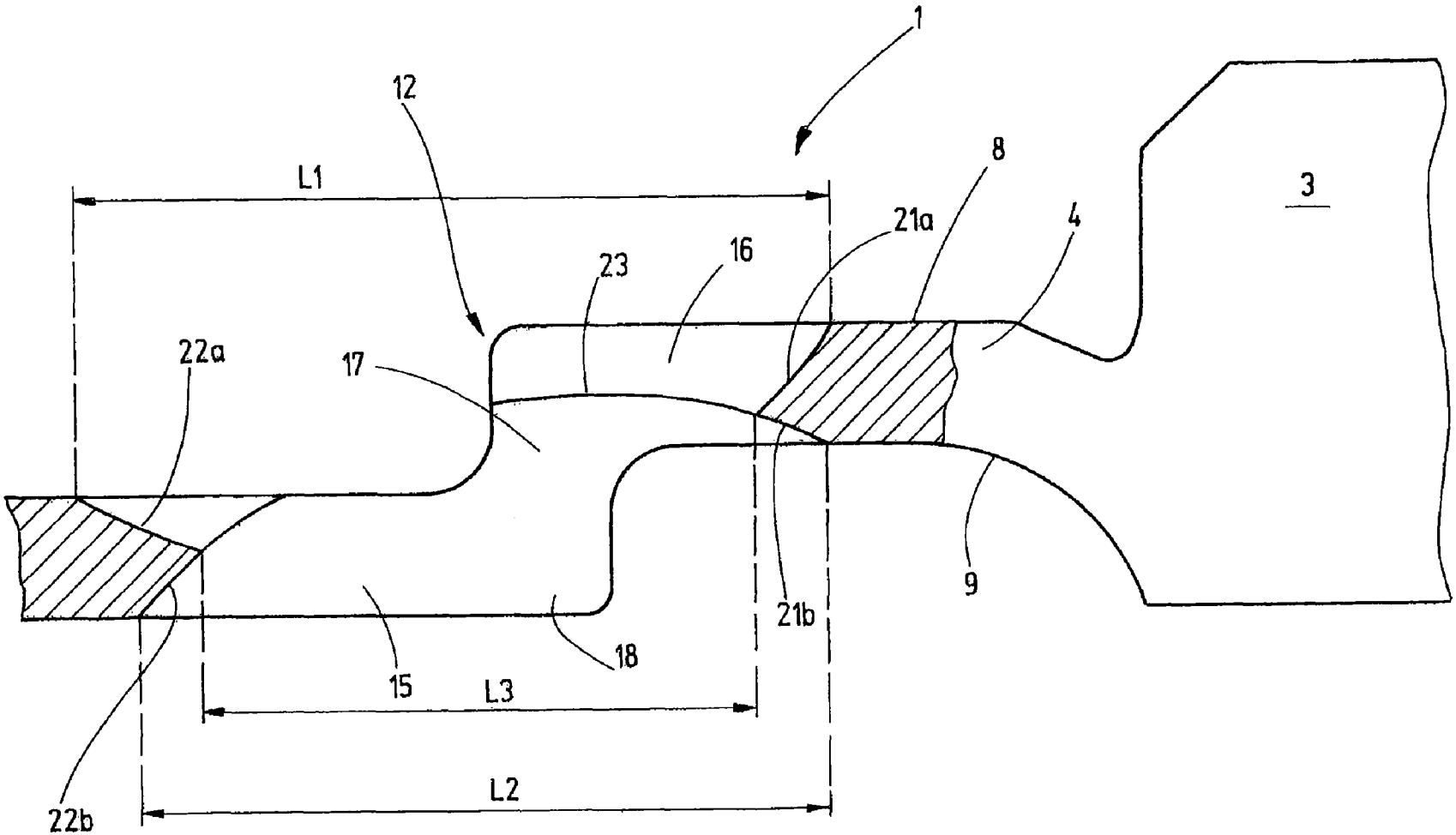

FIG. 6 shows another possible modification. In this case, the meander curve slit 18 has divided end surfaces 21*a*, 21*b*, 22*a*, 22*b*. The end surface sections 21*a*, 21*b* extend at an acute angle toward each other. Likewise, the end surface sections 22*a*, 22*b* extend at an acute angle toward each other. Each of them meets in a point inside the meander curve slit 18 that marks the narrowest inside point of the meander curve slit 18 and defines the distance L3. This distance is smaller than at least one of the distances L1, L2. The meander curve slit 18 may have a consistent uniform width or, as shown by FIG. 6, be provided with a step 23. At this step, the width of the meander curve slit 18 may change from a smaller value to a greater value. Preferably, this step smoothly adjoins the end surfaces 21*b* or, alternatively, also smoothly adjoins the end surface sections 21*a*, 22*a* that border the lower or the upper narrow side 9 or 8.

With the use of the aforementioned features that can be combined with each other in almost any fashion, the flexibility, stability, shock absorption capability, damping effect and fatigue strength of the shank 4 may be adjusted within wide limits and for the specific purpose.

A knitting machine needle 1 that is designed as a meander needle in accordance with the invention comprises at least one meander curve 12 that is provided with a meander curve slit 18 having the shape of a vertical slit that is parallel to the tongue slit. It is delimited by two side walls 19, 20 that are preferably aligned parallel to each other and circumscribe an open intermediate space.

It will be appreciated that the above description of the present invention is susceptible to various modifications and changes, and the same are intended to be comprehended within the meaning and range of equivalents of the appended claims.

LIST OF REFERENCE NUMERALS

1 Knitting machine needle
2 Needle body
3 Foot
4 Shank
5 Hook
6 Latch
7 Latch slit
8 Upper narrow side
9 Lower narrow side
10, 11 Lateral surfaces
12-14 Meander curves
NH Total height
15 First section
16 Second section
17 Third section
18 Meander curve slit
19, 20 Lateral walls
21, 22 End surface
L Longitudinal direction of needle
L1 Length on upper side of needle
L2 Length on lower side of needle
L3 Length in the meander curve slit
21*a*, 21*b* End surface sections
22*a*, 22*b* End surface sections
w1, w2 Acute angles
E Plane

What is claimed is:

1. Knitting machine needle comprising:

a needle body having at least one foot and a shank having an upper narrow side and a lower narrow side and a hook on one end, wherein the shank has at least one meander curve between the hook and the foot, said meander curve having at least one meander curve slit therein, with the meander curve slit extending through at least one of the upper and the lower narrow sides and having a uniform width along its entire length.

2. Knitting machine needle in accordance with claim 1, wherein the meander curve is defined by a first section of the shank extending in a longitudinal direction of the body, by a second section of the shank also extending in the longitudinal direction of the body and by a third section of the shank extending in a transverse direction thereto, wherein the third section is arranged between the first section and the second section and, with each of them, essentially subtends a right angle.

3. Knitting machine needle in accordance with claim 2, wherein the first section and the second section have a matching height (H).

4. Knitting machine needle in accordance with claim 1, wherein the meander curve slit extends through the upper narrow side as well as through the lower narrow side of the shank.

5. Knitting machine needle in accordance with claim 1, wherein the meander curve slit has rounded end surfaces.

6. Knitting machine needle in accordance with claim 2, wherein the meander curve slit extends through at least the first section.

7. Knitting machine needle in accordance with claim 2, wherein the meander curve slit extends through at least the second section.

8. Knitting machine needle in accordance with claim 2, wherein the meander curve slit extends through at least the third section.

9. Knitting machine needle in accordance with claim 1, wherein the needle is configured as a latch-type needle and has a latch slit that is arranged at a distance from the meander curve slit.

10. Knitting machine needle in accordance with claim 9, wherein the latch slit and the meander curve slit are arranged so as to be aligned with each other.

11. Knitting machine needle in accordance with claim 1, wherein the meander curve slit has a length (L1) on the upper narrow side, said length being greater than its length (L2) on the lower narrow side.

12. Knitting machine needle in accordance with claim 1, wherein the meander curve slit has a length (L2) on the lower narrow side, said length being greater than its length (L1) on the upper narrow side.

13. Knitting machine needle in accordance with claim 1, wherein the meander curve slit has a flat or bent end surface on one end, said end surface adjoining the upper or lower narrow side at an acute angle.

14. Knitting machine needle in accordance with claim 3, wherein the meander curve slit extends through each of the first, second and third sections.

* * * * *